United States Patent [19]

Bair

[11] Patent Number: 4,989,280

[45] Date of Patent: Feb. 5, 1991

[54] AUTOMATICALLY ACTUATED INVALID BED TOILET SYSTEM

[76] Inventor: Richard M. Bair, 902 Roselawn, Rochester, Mich. 48063

[21] Appl. No.: 475,837

[22] Filed: Feb. 6, 1990

[51] Int. Cl.[5] ..... A61G 7/02

[52] U.S. Cl. ..... 5/90; 5/455; 4/450

[58] Field of Search ..... 5/90, 463, 455; 4/450

[56] References Cited

U.S. PATENT DOCUMENTS

| | | | |
|---|---|---|---|
| 202,116 | 4/1878 | Price . | |
| 225,106 | 3/1880 | Campbell . | |
| 244,806 | 7/1881 | Henn . | |
| 247,496 | 9/1981 | Goodwin . | |
| 3,66,131 | 5/1972 | Thompson | 5/90 |
| 1,404,482 | 1/1922 | Sawyer . | |
| 1,490,029 | 4/1924 | Scheliga . | |
| 1,719,938 | 7/1929 | Kushner | 4/450 |
| 1,869,036 | 7/1932 | Zink | 4/450 |
| 2,204,343 | 6/1940 | Dawson | 5/90 |
| 2,279,307 | 4/1942 | Freund . | |
| 2,287,552 | 6/1942 | Dry | 5/90 |
| 2,384,325 | 9/1945 | Marsan | 5/90 |
| 2,443,905 | 6/1948 | Freund et al. . | |
| 2,614,267 | 10/1952 | Perri | 5/90 |
| 3,323,146 | 6/1967 | Kappel . | |
| 3,332,090 | 7/1967 | Wetzler . | |
| 3,503,083 | 3/1970 | Barnett . | |
| 3,562,824 | 2/1971 | White . | |
| 3,668,720 | 6/1972 | Wetzler . | |
| 3,822,425 | 7/1974 | Scales . | |
| 3,879,772 | 4/1975 | Pol . | |
| 3,887,951 | 6/1975 | Yates et al. . | |
| 3,909,858 | 10/1975 | Ducker . | |
| 3,922,735 | 12/1975 | Kato . | |
| 3,943,583 | 3/1976 | Ishikawa . | |
| 4,030,149 | 6/1977 | Kato | 5/463 X |
| 4,099,276 | 7/1978 | Hunt et al. . | |
| 4,127,906 | 12/1978 | Zur | 5/90 X |
| 4,190,913 | 3/1980 | DiMatteo et al. . | |
| 4,488,322 | 12/1984 | Hunt et al. . | |
| 4,490,865 | 1/1985 | Hamaguchi | 5/90 |
| 4,571,759 | 2/1986 | Sasaki et al. | 5/90 |
| 4,631,762 | 12/1986 | Fugett . | |
| 4,754,508 | 7/1987 | Nishiguchi . | |

FOREIGN PATENT DOCUMENTS

| | | | |
|---|---|---|---|
| 144374 | 9/1903 | Fed. Rep. of Germany | 5/90 |
| 56-13464 | 3/1981 | Japan | 5/463 |
| 60-85748 | 5/1985 | Japan | 5/90 |
| 8504800 | 11/1985 | World Int. Prop. O. | 5/90 |

OTHER PUBLICATIONS

Article titled "In Bed Toilet", designed by Richard M. Bar, dated Nov. 2, 1988.

Brochure, entitled "Low Air-Loss Bed", by Mediscus, Inc. 6700 Esat Pacific Coast Highway, Long Beach, Calif. 90803, (3 pages).

*Primary Examiner*—Eric W. Nicholson

*Attorney, Agent, or Firm*—Dykema Gossett

[57] ABSTRACT

An invalid toilet is disclosed which is used in combination with an air inflated hospital bed which typically have a plurality of individually inflatable air sacks. The invalid toilet is stored in a cabinet member in a position such that it makes efficient use of hospital space. A control means is disclosed that may be actuated by the patient to move the invalid toilet to a "use" position. The control means causes the air inflatable sack at the center of the hospital bed to deflate and the invalid toilet is moved over this central area. The control means provide a signal to a remote nurses station to allow the nurse to monitor the use of the invalid toilet by the patient. The nurses station is provided with a stop switch to stop movement of the invalid toilet. The control means also record the time of actuation. The invalid toilet contains storage containers which store waster material and clean water and these waste containers are made easily accessible to service personnel. The invalid toilet disclosed by this invention is relatively simple, makes sufficient use of space, and does not require frequent attention by service or medical personnel. Thus, it is a practical solution to the problems faced by patients in a hospital environment.

26 Claims, 15 Drawing Sheets

AUTOMATICALLY ACTUATED INVALID BED TOILET SYSTEM

BACKGROUND OF THE INVENTION

This invention relates to a invalid toilet that may be used in combination with a standard hospital bed to provide efficient use of hospital space and also to provide control features that had not been previously provided by prior art invalid toilets.

Patients are frequently required to remain in a hospital for a long period of time. In many modern hospital environments, these patients are not provided with adequate facilities for excretory functions. The facilities utilized by many hospitals require close attention by medical personnel in order to remove the waste materials. Due to shortages of medical staff, this close attention is not always available and thus the patient is not always comfortably provided for.

Invalid toilets are known in the prior art, but, in general, have been incorporated into a hospital bed structure. These devices are often extremely complex and may not be utilized with standard hospital beds already in use. Modern hospital beds have several features directed to the comfort of the patent and it would be preferable to utilize these standard beds.

In addition, the prior art did not always provide comfortable use of a invalid toilet by a patient nor did they always provide adequate cleaning of the patient after use. The prior art invalid beds did not always provide control features that would add to the comfort of the patient.

Due to all these deficiencies in most of the prior art invalid toilets, the actual devices utilized in hospitals have been manually changed devices such as bedpan. This requires a patient to wait the arrival of a nurse before being cleansed and in addition utilizes a great deal of scarce and expensive nursing time.

It is therefore an object of the present invention to disclose an automatically actuatable invalid toilet.

It is further an object of the present invention to disclose an improved invalid toilet that efficiently utilizes required space.

It is further an object of the present invention to disclose such an invalid toilet that may be utilized in combination with standard hospital beds.

It is further an object of the present invention to disclose such an invalid toilet that provides a number of controls to add to the comfort of a patient.

SUMMARY OF THE INVENTION

An improved invalid toilet Is disclosed that may be used In hospital beds by being placed alongside, and clamped to a standard hospital bed. The invalid toilet stores an elongated seat bedpan unit in an upright inactive position, thus utilizing a minimum space. Upon actuation of the invalid toilet by the patient, the seat bedpan unit is moved outwardly of an outer cabinet and rotated to a horizontal position. The seat bedpan unit is then moved over the hospital bed.

In a disclosed embodiment, the hospital bed has a plurality of inflatable air sacks. Upon actuation of the invalid toilet by the patient, the bed is moved to a position with the patient's head elevated above the center portion of the bed. Air inflatable sacks at the central portion of the bed are deflated and the seat bedpan unit is moved outwardly over the central portion. The air inflated sacks are then reinflated and the seat bedpan unit is moved to a "use" position. The seat bedpan unit positioned over the bed includes a macerator pump to dispose of solid waste and a system to send clean water to the patient for cleansing purposes.

In a preferred embodiment, a button begins movement of the invalid toilet to a "use" position. Actuation of this button provides a signal to a nurse station and activates a video system so a nurse can observe the patient. The nurse has an override "stop" button to deactivate the system if the patient or hospital bed is in an improper position. The system also records the time of the actuation of the button and the position of the patient.

In a most preferred embodiment of the present invention, the seat bedpan unit is mounted in an inner cabinet slidably disposed within the outer cabinet. The outer cabinet has access doors at each lateral side and the inner cabinet is movable from a position within the outer cabinet to a first position when it extends outwardly of the outer cabinet through the access door at the lateral side away from a hospital bed. Once the inner cabinet has been moved to this second position, a rotation assembly rotates the seat bedpan unit relative to the inner cabinet from a vertical position to a horizontal position, this is defined as a third position. Once rotated, the seat bedpan unit extends outwardly of the outer cabinet through the access door in the lateral side facing the hospital bed. The inner cabinet is retracted into the outer cabinet and moves the seat bedpan unit to a fourth position further upon the hospital bed. A motor that rotates with the seat bedpan unit then drives it an additional distance, separately from either the inner cabinet or the rotating assembly, to a fifth position such that the seat bedpan unit completely overlies the center portion of the hospital bed. The air inflatable sacks in the center portion of the hospital bed are now inflated and the seat bedpan unit pivots slightly upwardly to a final sixth "use" position. The patient may then utilize the system.

When finished, the patient actuates a "done" button to start the macerator pump and the water supply system to flush the seat bedpan unit. Clean water and waste materials are stored within storage containers in the outer cabinet and remain there until serviced by service personnel. The storage containers are easily accessible through bolted covers and may be easily accessed for cleaning.

These and other objects and features of the present invention can be best understood from the following specification and drawings, of which the following is a brief description.

DETAILED DESCRIPTION OF A DISCLOSED EMBODIMENT

Figure 1:
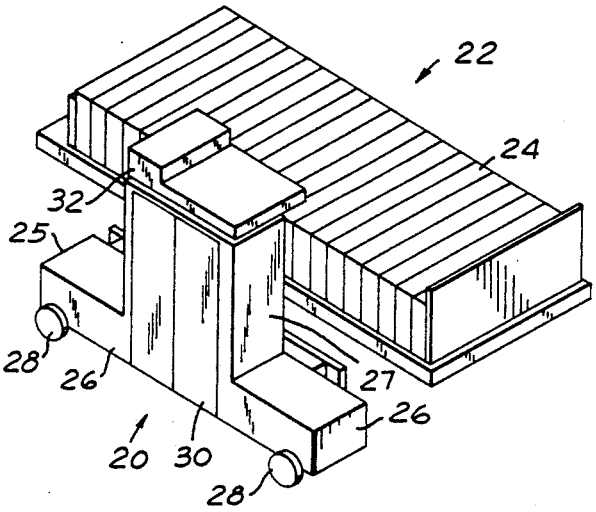
FIG. 1 is a perspective view showing a invalid toilet positioned next to a hospital bed.

FIG. 1 illustrates invalid toilet 20 is shown in combination with hospital bed 22 which has a plurality of individually inflatable air sacks 24. Invalid toilet 20 consists of a outer cabinet 25 having two vertically lower side portions 26 and a vertically higher central portion 27. Wheels 28 support outer cabinet 25. Doors 30 extend throughout the height of enlarged central portion 27 on a side of cabinet 25 facing away from invalid bed 22. Control tray 32 is mounted on top of cabinet 25.

Figure 2:
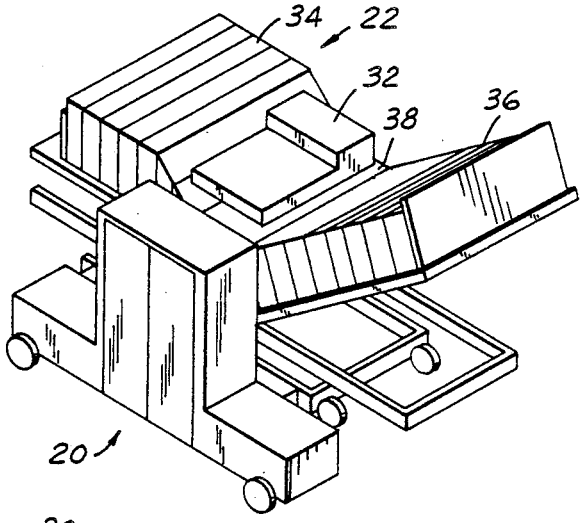
FIG. 2 is an illustration similar to FIG. 1 showing the hospital bed in an actuated position.

FIG. 2 illustrates the combination of invalid toilet 20 and hospital bed 22 having been moved to an actuated position. Control tray 32 is pivoted outwardly over hospital bed 22. A foot portion 34 of hospital bed 22 remains relatively parallel to the ground while a head portion 36 has been pivoted upwardly. The air sacks 24 in a center area 38 have been deflated and hospital bed 22 has a relatively thin vertical profile in the center area 38.

Figure 3:
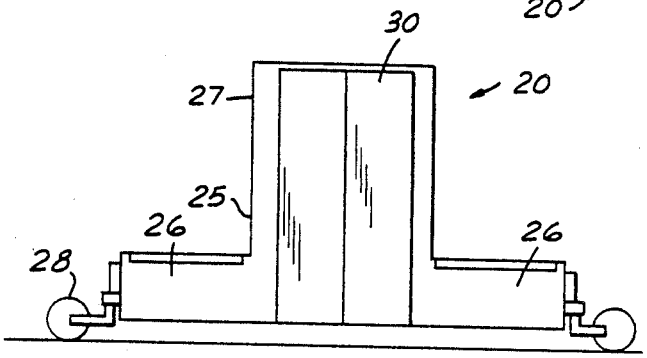
FIG. 3 is a side view of invalid toilet.

Outer cabinet 25 is illustrated in FIG. 3 and contains side portions 26, central portion 27, elongated doors 30 and wheels 28. As disclosed above, elongated doors 30 are on a side of outer cabinet 25 removed from hospital bed 22.

Figure 4:
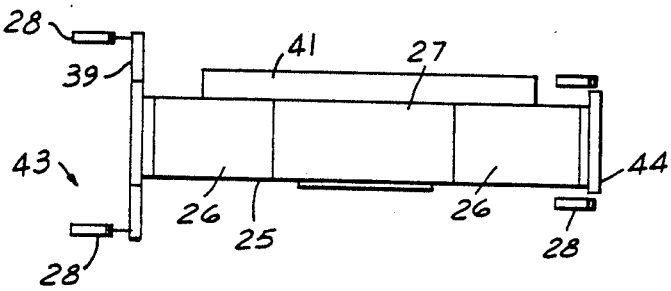
FIG. 4 is a top view of the invalid toilet.

FIG. 4 shows outer cabinet 25 having side portions 26 and central portion 27 along with a storage portion 41 on side facing hospital bed 22. Wheels 28 on the left hand side of outer cabinet 25, as illustrated in this Figure, are shown in a position 43 laterally extended through extension members 39. Wheels 28 at the opposite end are shown in retracted position 44. Wheels 28 are moved between the extended 43 and retracted 44 position to provide better stability to outer cabinet 25.

Figure 5:
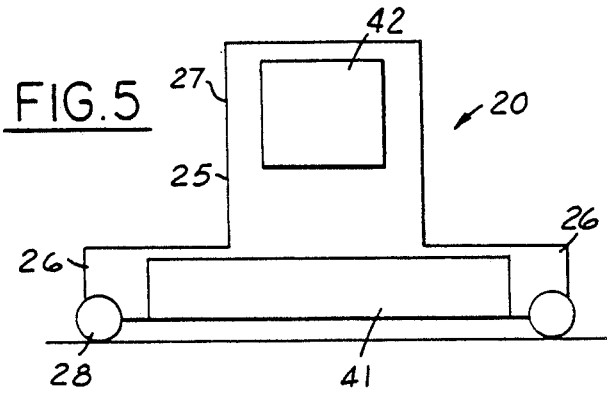
FIG. 5 is a side view of the invalid toilet.

As shown in FIG. 5, outer cabinet 25 has access panel 42 on a side facing hospital bed 22. Access panel 42 is formed in elongated central portion 27.

Figure 6:
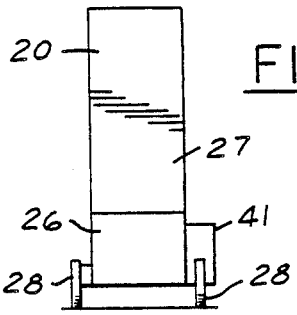
FIG. 6 is an end view of the invalid toilet.

FIG. 6 is a end view of invalid toilet 20 showing vertically extended central portion 27 and vertically lower side portion 26 along with storage area 41. Wheels 28 are shown in the retracted position.

Figure 7:
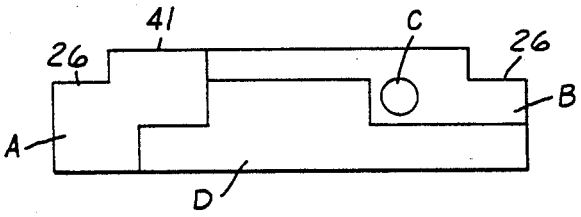
FIG. 7 is a lagely schematic top cross-sectional view of the invalid toilet.

FIG. 7 is a largely schematic top cross-sectional view showing the preferable use of several areas of cabinet 25. Area A will contain a waste water holding tank. Area B contains a clean water storage tank. Area C contains a submersible pressure water pump. Area D contains a drive motor to move a seat bedpan unit horizontally. Area E contains a drive motor for rotating the seat bedpan unit.

Figure 8:
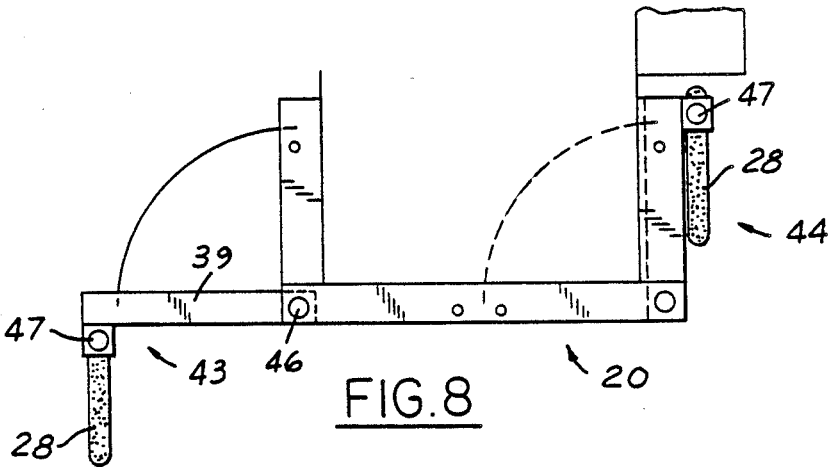
FIGS. 8 and 9 show details of a wheel attached to the invalid toilet.

FIG. 8 shows details of the extension member 39 for moving wheel 28 between extended position 43 and retracted position 44. Wheels 28 are pinned at 47 to extension member 39 and pivot about pivot point 46 when moving between extended 43 and retracted 44 positions. When wheels 28 are in extended position 43 they provide greater stability to outer cabinet 25.

Figure 9:
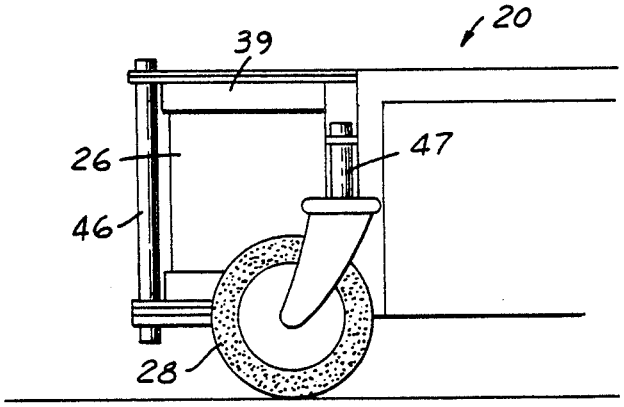

FIG. 9 is a partial view of side section 26 illustrating wheel 28 pinned to extension member 39 at pin 47 and pinned to side section 26 at pivot point 46.

Figure 10:
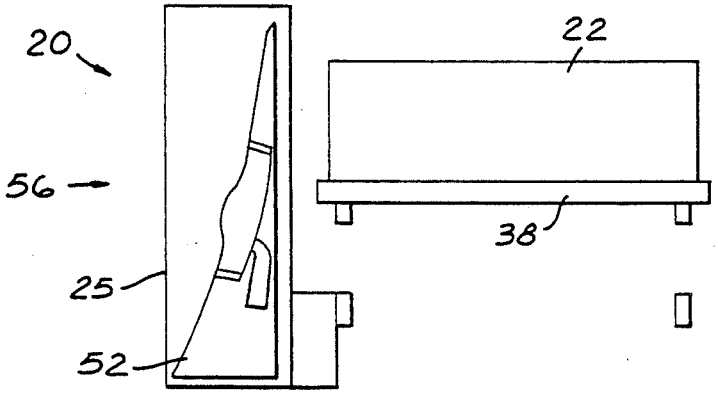
FIGS. 10–15 illustrate a seat bedpan unit in first to sixth positions.

FIG. 10 is a largely schematic view showing invalid toilet 20 in a first unactuated position. The air sacks at center area 38 of hospital bed 22 is deflated. Outer cabinet 25 receives seat bedpan unit 52.

Figure 11:
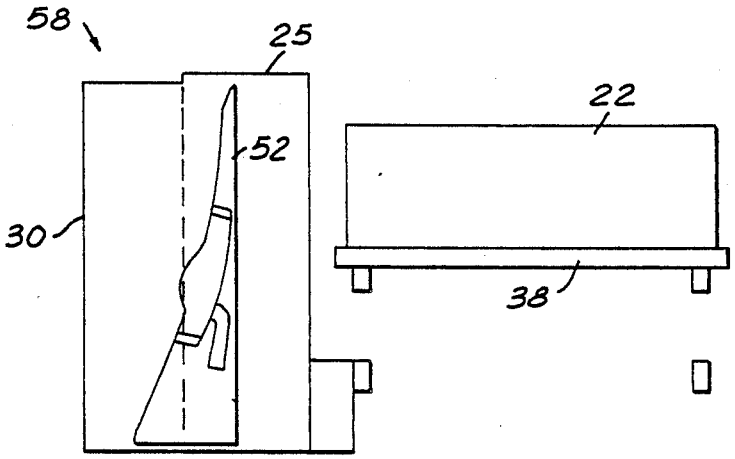

FIG. 11 illustrates the second position 58 of seat bedpan as it moves to a "use" position. Elongated doors 30 are swung outwardly and seat bedpan unit 52 moves outwardly of cabinet 25, away from hospital bed 22.

Figure 12:
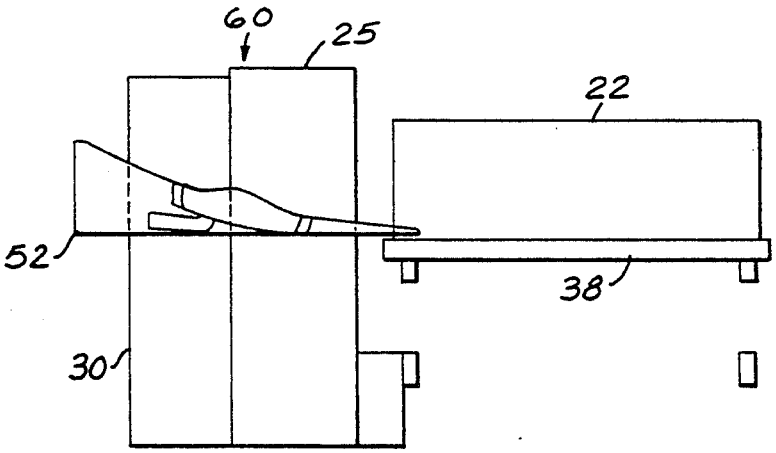

FIG. 12 shows a third position 60 of seat bedpan unit 52. Seat bedpan unit 52 has moved outwardly of elongated doors 30, has been rotated vertically upwardly from position 58 illustrated in FIG. 11, and now partially rests on center area 38 of hospital bed 22.

Figure 13:
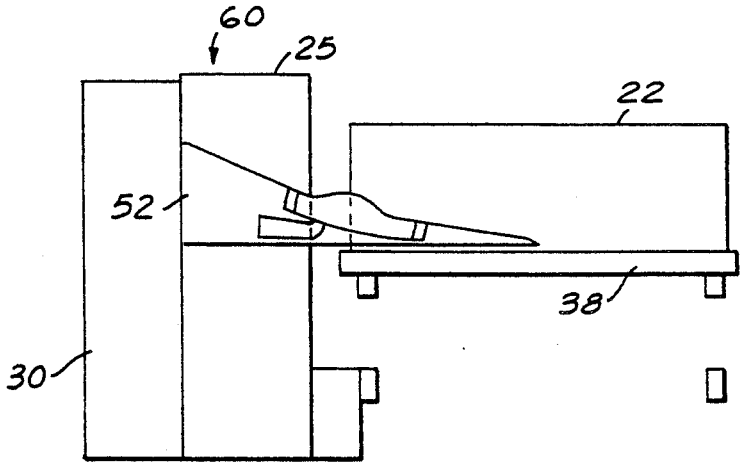

FIG. 13 shows a fourth position 62 in the movement of seat bedpan unit 52 to a "use" position. Seat bedpan unit 52 has now moved horizontally into and through outer cabinet 25. Although it is not shown in this drawing seat bedpan unit 52 has opened access panel 42 and extends outwardly toward hospital bed 22. Seat bedpan unit 52 now overlies center area 38.

Figure 14:
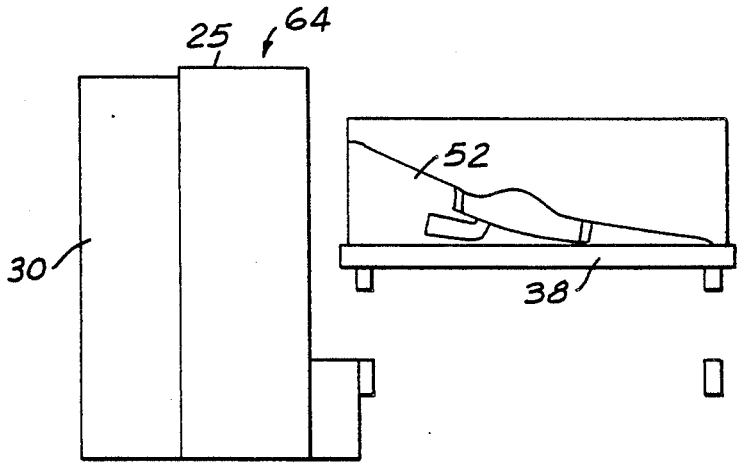

FIG. 14 shows a fifth position 64 in which seat bedpan unit 52 has been moved entirely through outer cabinet 25 and is now completely received upon center area 38 of hospital bed 22.

Figure 15:
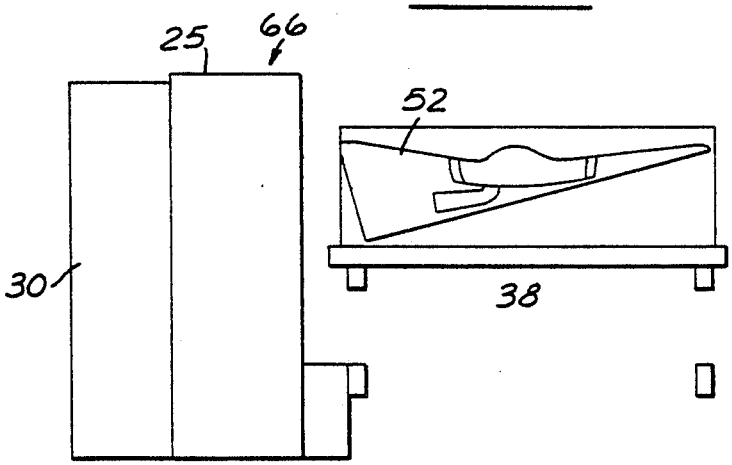

FIG. 15 shows a sixth position 66 in which seat bedpan unit 52 has been pivoted upwardly from fifth position 64. This upward pivotal movement is accomplished by partially inflating the air sacks sections at center area 38 of hospital bed 22.

FIGS. 10–15 schematically show the movement of a seat bedpan unit 52 between an unactuated position and a "use" position where it may be utilized by a patient for excretory functions. A preferred embodiment of the various mechanical drives necessary to provide the movement between the various positions will now be disclosed in more detail. However, it should be understood that any mechanical drive that could provide these movements may be utilized.

Figure 16:
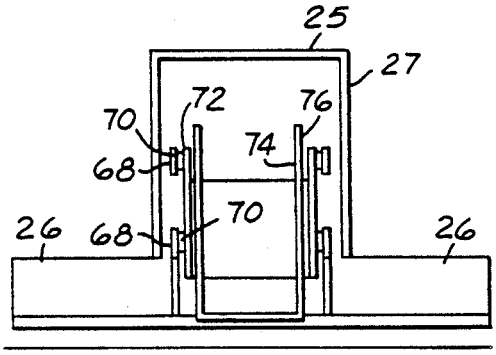
FIG. 16 is a largely schematic view showing details of the invalid toilet including inner and outer cabinets.

As shown in FIG. 16, central section 27 of outer cabinet 25 receives drawer guides 68 that are fixed to central section 27. An inner cabinet 72 has mating drawer guides 70 received for sliding movement within drawer guides 68. These drawer guides 68 and 70 may be any type of standard drawer guides.

Rotating pins 74 pivotally mount rotating bar 76 within inner cabinet 72. Rotating bar 76 extends beneath inner cabinet 72 which is generally C-shape in cross-section when viewed from the top.

Figure 17:
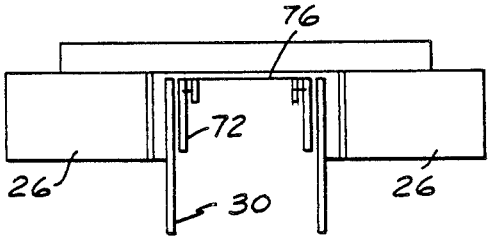
FIG. 17 is a top view of the inner cabinet when the invalid toilet is in a first position.

FIG. 17 is a top view showing the cross-sectional shape of inner cabinet 72 and its movement between a retracted position and an extended position. Inner cabinet 72 is shown in solid line at a retracted position and in phantom line after having been driven horizontally to an extended position. The mechanism for driving inner cabinet 72 will be described below.

Figure 18:
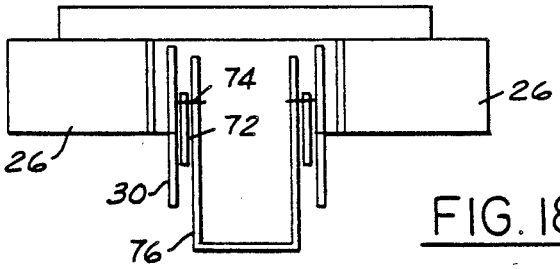
FIG. 18 is a view similar to FIG. 17 but showing the second position of the invalid toilet.

FIG. 18 shows inner cabinet 72 after having been driven to an extended position and rotating bar 76 having been driven to rotate and move the seat bedpan unit between second and third positions. The mechanism for driving rotating bar 76 will be described below.

Figure 19:
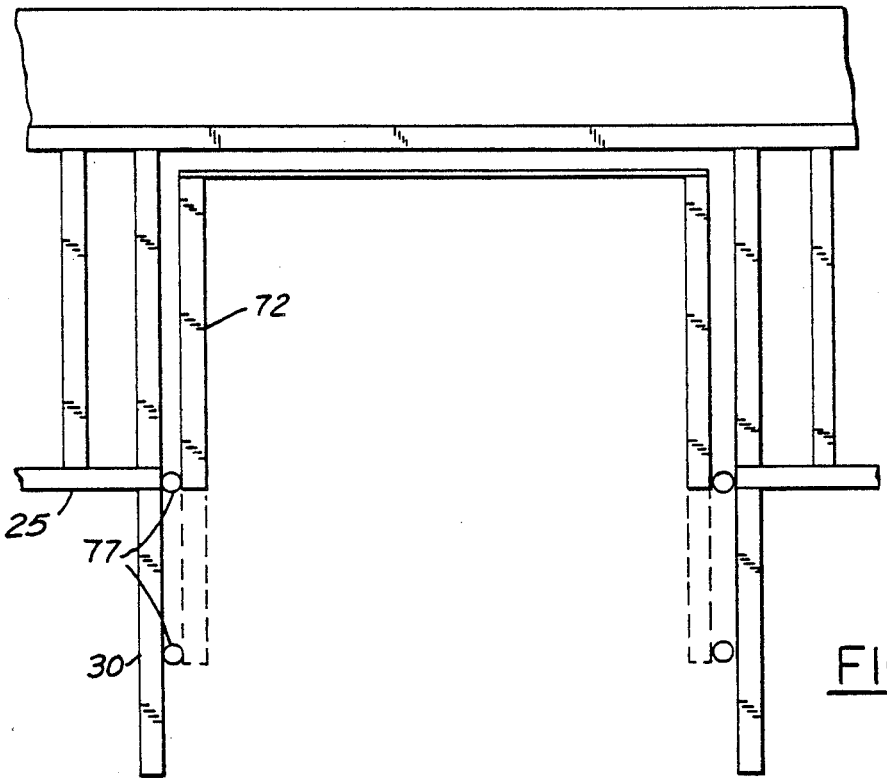
FIG. 19 is a top view showing movement of the inner cabinet between extended and retracted positions.

FIG. 19 is a view of inner cabinet 72 and its movement between extended and retracted positions. In addition to the drawer guides 68 and 70 (not shown in this Figure), rollers 77 are placed on the outer position of inner cabinet 72 to guide it along elongated doors 30 as it moves outwardly of outer cabinet 25 to an extended position.

Figure 20:
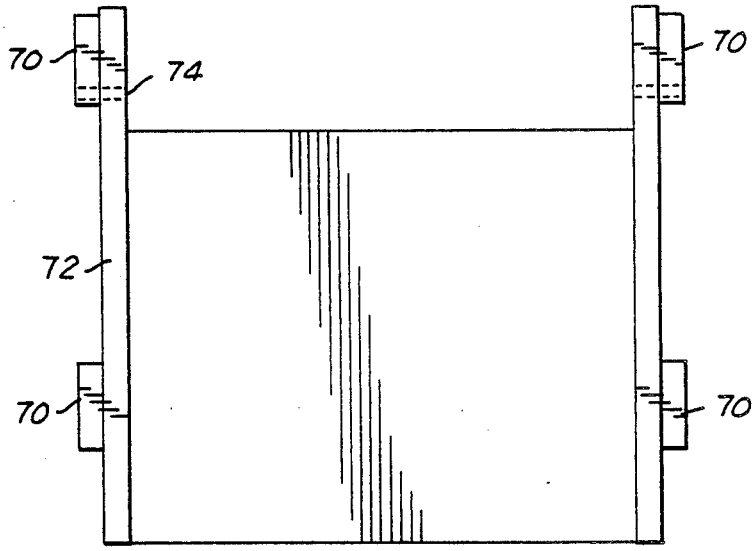
FIG. 20 is a front view of an inner cabinet.

FIG. 20 is a front view of inner cabinet 72 looking inwardly from doors 30. Drawer guides 70 are attached to each side and rotation pins 74 is shown at vertically upper positions.

Figure 21:
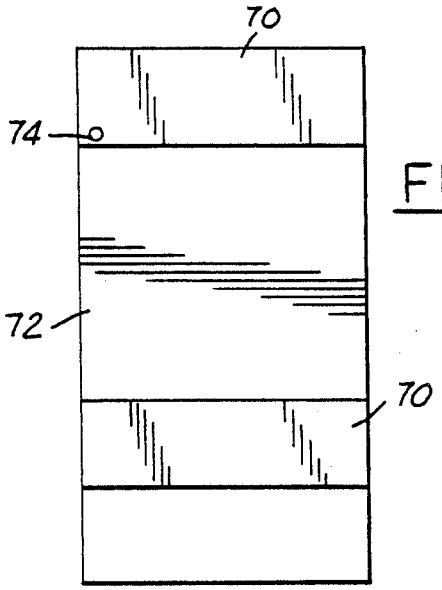
FIG. 21 is a side view of the inner cabinet.
Figure 22:
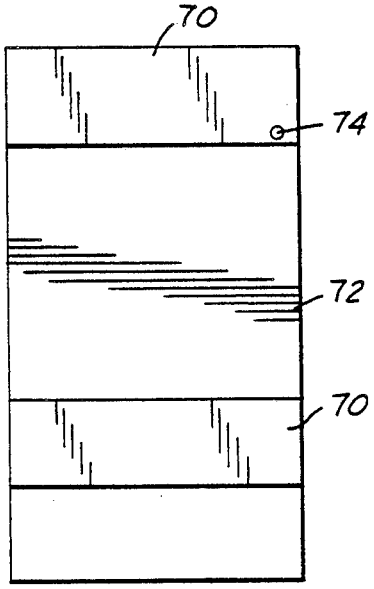
FIG. 22 is a side view of the inner cabinet.

FIGS. 21 and 22 are side views showing inner cabinet 72, having drawer guides 70 and also illustrating the relative position of rotating pins 74.

Figure 23:
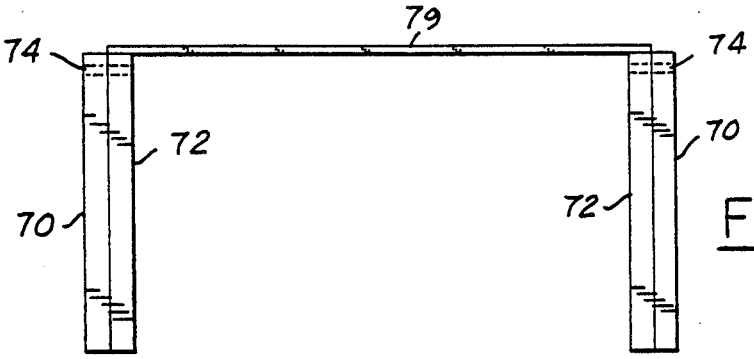
FIG. 23 is a top view of the inner cabinet.

FIG. 23 is a top view of inner cabinet 72 and illustrates drawer guides 70 and pivot pins 74 mounted near a rearward position. Rear wall 79, in combination with side walls of inner cabinet 72 give inner cabinet 72 a generally C-shaped configuration. There is no bottom member to inner cabinet 72 and thus rotating bar 76, which is rotatably attached at pivot pins 74 can extend vertically below inner cabinet 72.

Figure 24:
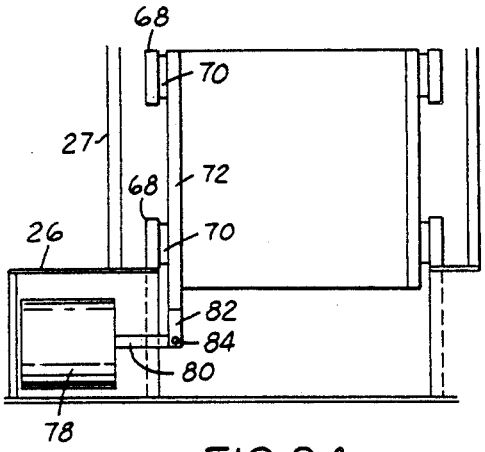
FIGS. 24 and 25 are largely schematic views of a mechanism for moving the inner cabinet.

FIG. 24 is a front view of inner cabinet 72 showing drawer guides 70 received within drawer guides 68 for sliding movement outwardly of outer cabinet 25. First drive motor 78 moves inner cabinet 72 horizontally through three-angle shaft 80 connected to bracket 82 through drive rod 84. Drive motor 78 is preferably a rotary motor, with shaft 80 being connected to inner cabinet 72 through a sleeve in bracket 82 in such a way that the rotary movement of shaft 80 is converted to sliding movement of inner cabinet 72.

Figure 25:
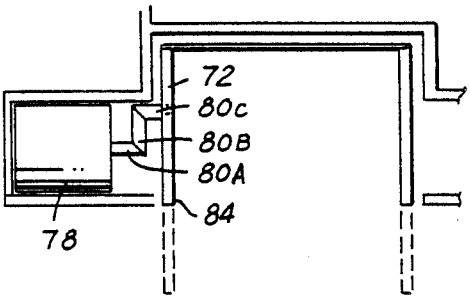

FIG. 25 is a top view showing inner cabinet 72 in retracted position and in phantom line having been moved horizontally by motor 78 to an extended position. Shaft 80 is formed from three separate angle gear drives 80A, 80B and 80C. Motor 74 rotates drive 80A, which rotates drive 80B which rotates drive 80C. Drive 80C rotates drive rod 84, which is threaded and guided in bracket 82 such that rotation of drive rod 84 cause bracket 82 to reciprocate. Drive rod 84, and the rest of the drive connection is fixed to outer cabinet 25, and does not move with inner cabinet 72. This drive connection, and particularly the mounting of the drives, is shown somewhat schematically since it utilizes known parts. Any other type of connection between motor 78 and inner cabinet 72 that changes the rotary movement of shaft 80 to sliding movement of inner cabinet 72 may be utilized.

Figure 26:
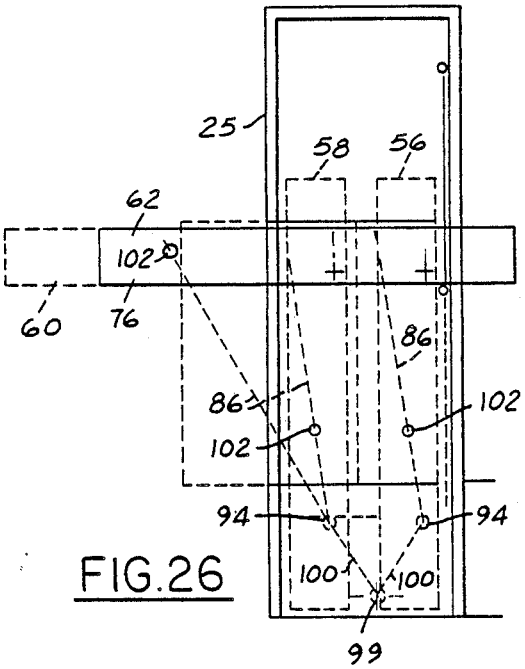
FIG. 26 illustrates the rotation and movement of the seat bedpan unit vertically upwardly as it moves between its first and fourth positions.

FIG. 26 shows the movement of rotating bar 76 between the first four positions of movement for seat bedpan unit 52. Rotating bar 76 is driven to rotate by threaded drive bar 86. Rotating bar 76 is shown in the unactuated first position 56 received within central section 27. At 58, rotating bar has been moved horizontally to the second position. The rotated third position 60 is illustrated with rotating bar 76 extending outwardly of elongated doors 30. The fourth position 62 is illustrated with rotating bar 76 having been moved back within central section 27 and extending through access panel 42. Drive 94 rotates threaded drive bar 86 in a manner explained below. Threaded drive bar 86 is received within sleeve 102 attached to rotating bar 76. As threaded drive rod 86 rotates within sleeve 102, sleeve 102, and rotating bar 76, advance axially along the threaded drive rod 86. Rotating bar 76 pivots relative to inner cabinet 72 on pivot pins 74, which are vertically above sleeve 102 when in the unrotated position, and further toward bed 22 when in the rotated position. Sleeve 102 pivots relative to rotating bar 76 such that the varying angles between the rotating bar 76 and threaded drive rod 86 are compensated for as the rotating bar 76 moves between its first four positions.

When in the unrotated first and second positions 56 and 58, threaded drive rod 86 extends through sleeve 102 for a relatively great extent. However, once rotating bar 76 has been moved to the third and fourth positions 60 and 62, threaded drive rod has moved sleeve 102 up near its end. A source of rotary drive 99 is illustrated along with three angle drive 100 which transmits rotation to threaded drive rod 86 in a manner to be described below. The relative positions of drive 94, free angle drive 100 and drive 99 are shown for the first and second positions of the rotating bar 76. As inner cabinet 72 moves axially outwardly of outer cabinet 25, drive 94 also moves along therewith. As shown in FIG. 26, drive 94 rotates counter-clockwise about drive 99. Drive 99 remains relatively fixed during movement of the drive mechanism of this invention. As drive 94 rotates between the first and second positions, the length of angle drive 100 can be adjusted vertically to compensate for the change in distance between drive 99 and drive 94. This feature will be explained with reference to FIG. 27.

Again, although a specific drive connection has been disclosed, any type of connection that allows rotating bar 76 to rotate between a vertically aligned position to a horizontally aligned position relative to inner cabinet 72 may be utilized.

Figure 27:
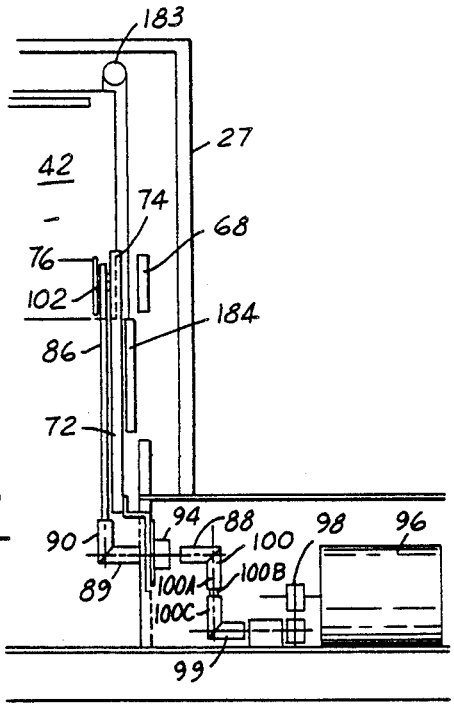
FIG. 27 is a largely schematic view of a mechanism for rotating the seat bedpan unit.

The connection of threaded drive bar 86 to rotating bar 76 is illustrated in FIG. 27. Drive bar 86 is driven by motor 96 which is connected through belt 98, through drive 99, to a angle drive shaft 100. Drive shaft 100 consists of two separate angle gears 100A and 100C with an intermediate sliding member 100B. The intermediate sliding member 100B allows the distance between drive 94 and drive 99 to adjust vertically downwardly as inner cabinet 72 moves between the first and second position. Drive 100A thus slides downwardly on intermediate member 100B, such that the distance between drive 94 and drive 99 is adjusted. Drive 100C is rotated by angle drive 99 and in turn rotates drive 100A. Drive 100A is an angle drive which rotates drive 88 which extends through an opening 94 in inner cabinet 72. Drive 88 in turn drives angle drive 89 which rotates drive 90. Drive 90 rotates along threaded drive rod 86. As explained above, threaded drive rod 86 is received within sleeve 102 which is pivotally connected to rotating bar 76. Thus, upon rotation of motor 96, threaded drive rod 86 is rotated and sleeve 102 is moved to raise rotating bar 76 to its horizontally aligned position.

FIG. 27 shows a further feature including weight 104 connected through pulley 183 to access panel 42. Seat bedpan unit 52 moves outwardly against access panel 42 and pivots it open. Once seat bedpan assembly 52 has moved back into and through access panel 42, weight 184 closes access panel 42. Thus, access panel 42 is only opened when seat bedpan unit 52 is moved outwardly therethrough and will be self closing once the seat bedpan unit 52 has moved back within access panel 42.

Figure 28:
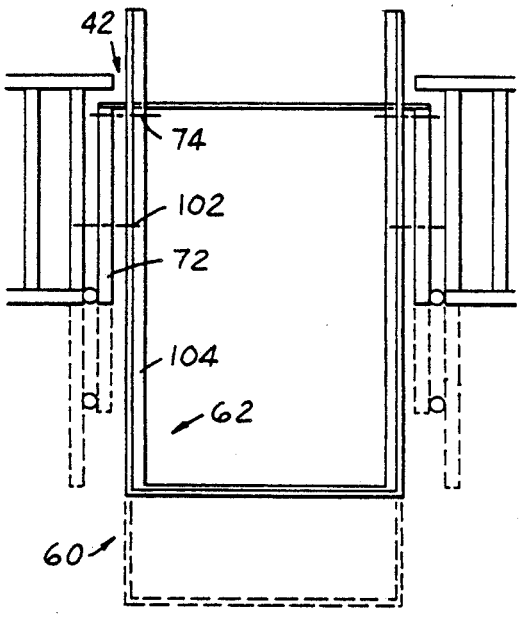
FIG. 28 is a largely schematic view showing the movement of the seat bedpan assembly between its third and fourth positions.
Figure 29:
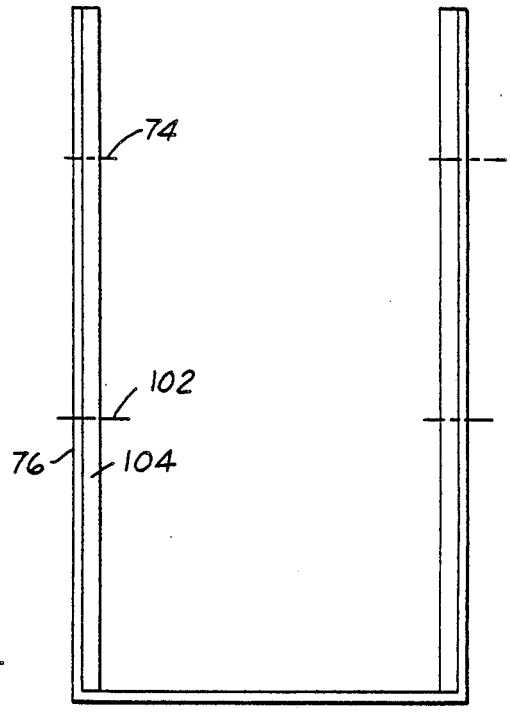
FIG. 29 is a side view of a rotating bar for a seat bedpan unit.

FIG. 28 illustrates the movement of rotating bar 76 from third position 60 to fourth position 62. Third position 60 of rotating bar 76 is shown in phantom line, as is the third position of inner cabinet 72. Once rotating bar 76 has rotated upwardly such that seat bedpan unit 52 is in third position 60, the inner cabinet 72 is moved rearwardly to its retracted position. Rotating bar 76 moves along therewith and extends through access panel 42. Slides 104 are formed within rotating bar 76 and slidably mount seat bedpan unit 52. As shown in FIG. 29, rotating bar 76 is essentially C-shaped in cross-section. The location of pivot pin 74 which pivotally connect rotating bar 76 to inner cabinet 62 are shown as is the pivotal connection 102 which pivotally connects rotating bar 76 to adjustable drive bar 86. Drawer guides 104 are shown on an inner face of both lateral sides of rotating bar 76.

Figure 30:
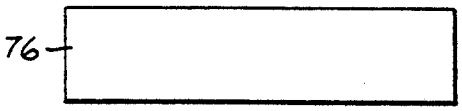
FIG. 30 illustrates a bottom view of the rotating bar.
Figure 31:
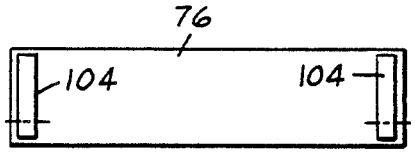
FIG. 31 illustrates a top view of the rotating bar.

FIGS. 30 and 31 show both ends of rotating bar 76 and illustrate the tour guides 104 at the laterally inward face of each side.

Figure 32:
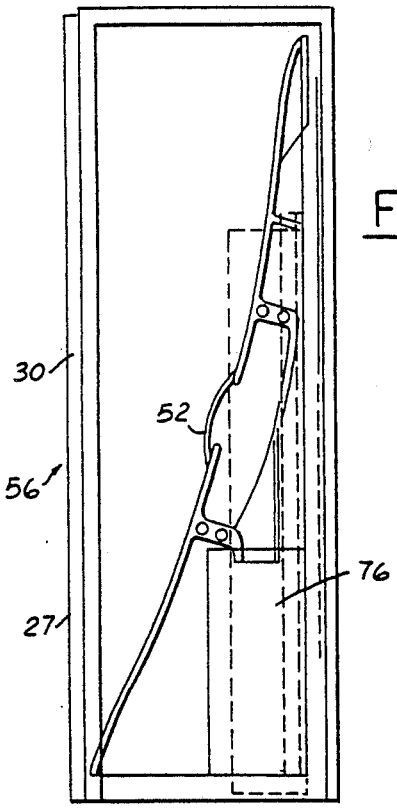
FIGS. 32–37 illustrates the seat bedpan unit, the inner cabinet and the rotating bar in first to sixth positions.

FIG. 32 shows the unactuated first position 56 of seat bedpan unit 52 with rotating bar 76 extending vertically upwardly and inner cabinet 72 in a retracted position.

Figure 33:
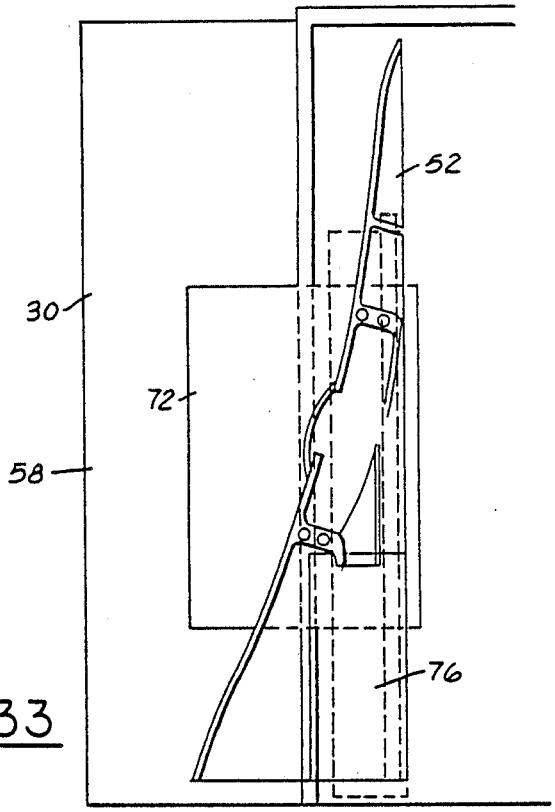

FIG. 33 shows the seat bedpan unit 52 having been moved to a second position 58. Inner cabinet 72 has slid forwardly on the roller guides as explained above and now extends outwardly of elongated doors 30. Rotating bar 76 still extends vertically upwardly.

Figure 34:
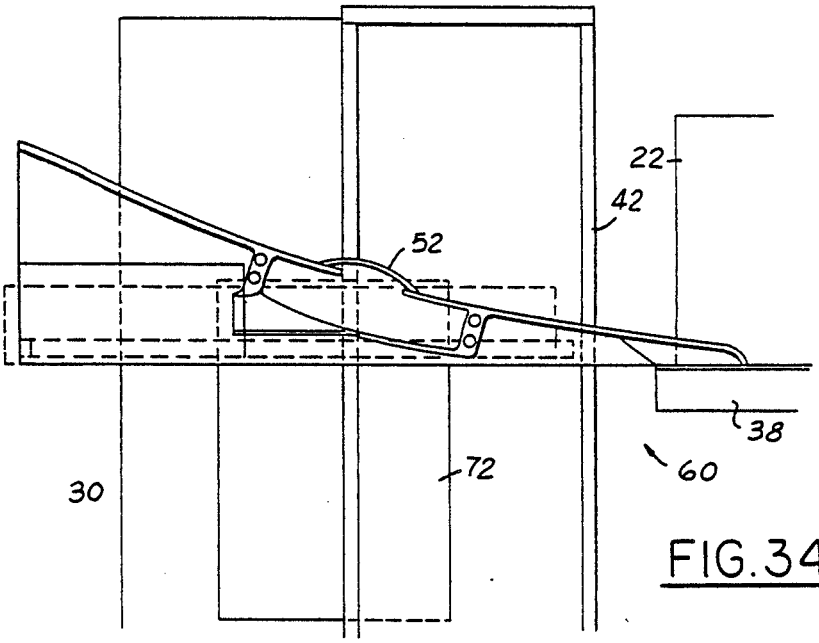

As shown in FIG. 34, seat bedpan unit has been rotated vertically upwardly to third position 60. This rotation causes seat bedpan unit 52 to extend through access panel 42. Inner cabinet 72 is still at an extending position outwardly of elongated doors 30. Seat bedpan assembly 52 now partially rests on a port of center area 38 of hospital bed 22.

Figure 35:
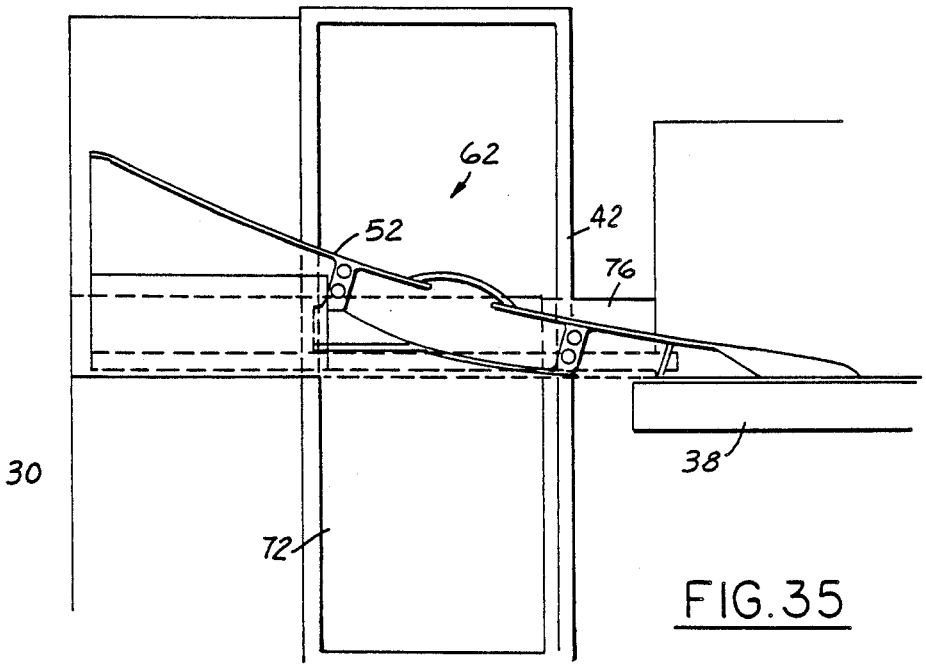

As shown in FIG. 35, seat bedpan assembly 52 has been moved to its fourth position 62. Inner cabinet 72 is moved rearwardly back to its retracted position and seat bedpan unit 62 move along therewith. Rotating bar 76 remains rotated and seat bedpan unit 52 is further advanced along the center area 38 of hospital bed 22.

Figure 36:
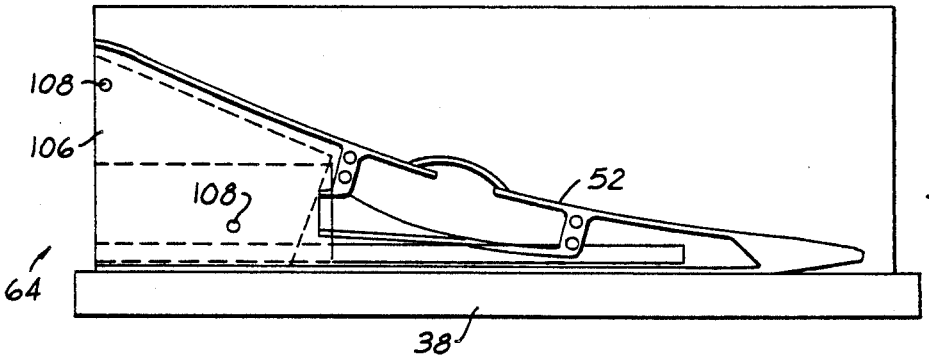

As shown in FIG. 36, seat bedpan assembly 52 has been advanced to fifth position 62. Seat bedpan unit 52 is driven by a linear motor to slide along slide guides 104 formed within rotating bar 76.

Figure 37:
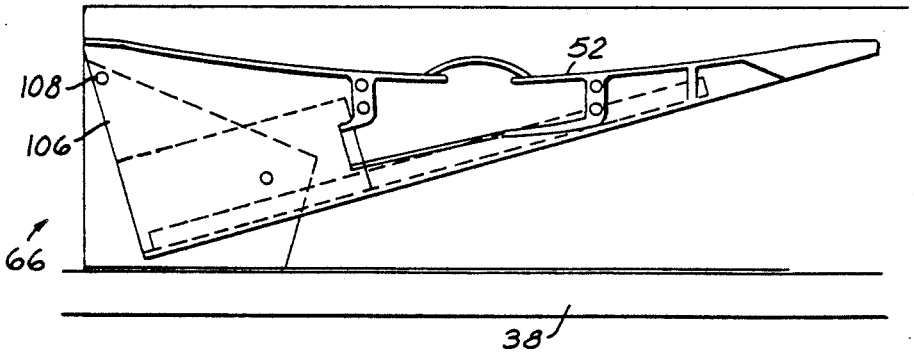

As shown in FIG. 37, seat bedpan assembly 52 has moved upwardly to fifth position 62. Seat bedpan assembly 52 is guided upon pivot guides 106 to pivot at points 108 and move upwardly at an end furthest removed from outer cabinet 25. The air sacks at center portion 38 of hospital bed 22 are inflated and drive seat bedpan unit 52 upwardly about pivot points 108. It should be understood that it is guides 106 that slide within drawer guides 104. Once seat bedpan unit 52 reaches the sixth position a signal is given to the patient that invalid toilet 20 is ready for use.

Figure 38:
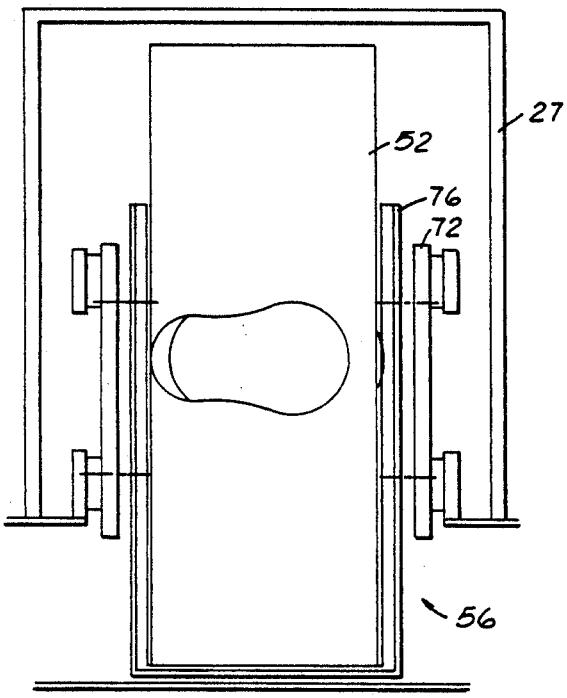
FIG. 38 is an end view of the seat bedpan unit, the rotating bar, and the inner cabinet.

FIG. 38 shows a front view of seat bedpan unit 52, rotating bar 76 and inner cabinet 72. This is a front view when seat bedpan unit 52 is a first position 56.

Figure 39:
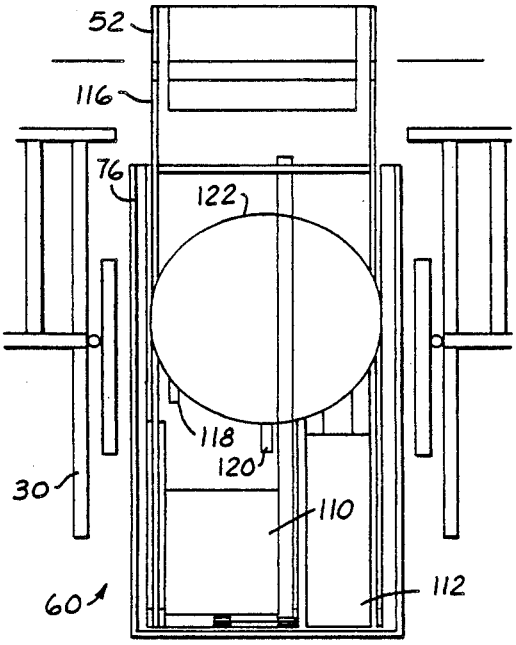
FIG. 39 is a view showing further details of the seat bedpan unit.

FIG. 39 shows view looking upwardly at invalid toilet 20 with seat bedpan unit 52 rotated upwardly to third position 60. As shown, inner cabinet 72 has moved outwardly of elongated doors 30 and rotating bar 76 has rotated vertically upwardly. Also, third drive motor 110 is fixed to rotate with rotating bar 76. A macerator pump 112 for disposing of solid waste through line 114 also rotates with rotating bar 76. Seat portion 116 is slidably mounted within rotating bar 76 on guide elements 104. Lines 118 and 120 are connections for supply of water to toilet bowl 122.

Figure 40:
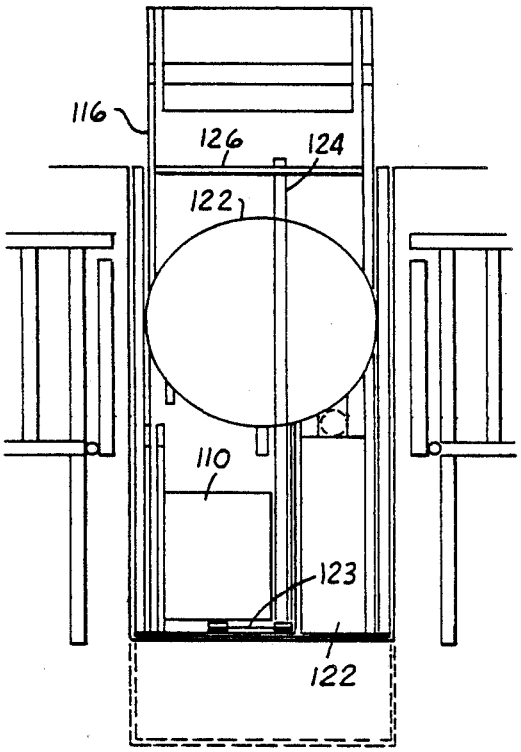
FIG. 40 shows the movement of the seat bedpan unit between the third and fourth positions.

FIG. 40 shows the movement of the device illustrated in FIG. 36 but moved forwardly to fourth position 62. Rotating bar 76 has moved forwardly through access panel 42 as has the remainder of seat bedpan assembly 52.

Third drive motor 110 rotates and drives a belt 122 which is connected to a threaded drive rod 124. Drive rod 124 rotates within cross bar 126. Cross bar 126 is connected to seat portion 116 and the entire seat portion 116 is constrained from rotating along with threaded drive rod 124. Thus, as drive rod 124 rotates within cross bar 126, it drives cross bar 126 to reciprocate further over the hospital bed 22 and also to return therefrom. This third drive motor drives seat portion 116 from fourth position 62 to the fifth position 64. Macerator pump 112 and the fluid connections move along with seat portion 116. Third drive motor 110 and threaded drive rod 124 do not move with seat portion 116 but remain with rotating bar 76.

Figure 41:
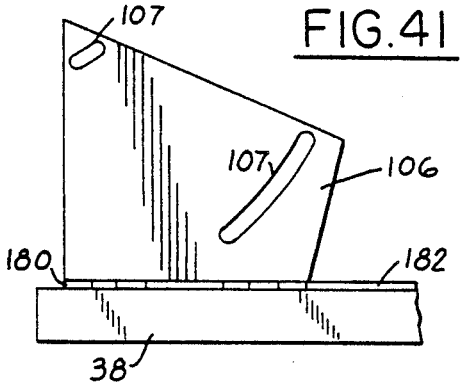
FIG. 41 shows details of the means for moving the seat bedpan unit between the fifth and sixth positions.

FIG. 41 shows details of guides plates 106 which include curved slots 107 for guidably supporting seat toilet bowl 122. Toilet bowl 122 is attached to guide plates 106 through pivot points 108 to pivot upwardly between guides plates 106.

Also, center portion 38 has slide members 182 which are connected to slide member 180 fixed to guide plates 106. Guide plates 106 have curved slots 107 which receive pivot pins 108.

Figure 42:
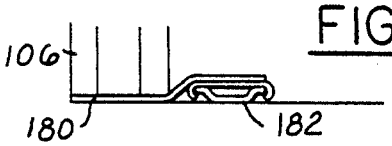

As shown in FIG. 42, guides 180 are received above drawer guides 182 and guide plates 106 as they move axially between the fourth position 62 and the fifth position 64.

Figure 43:
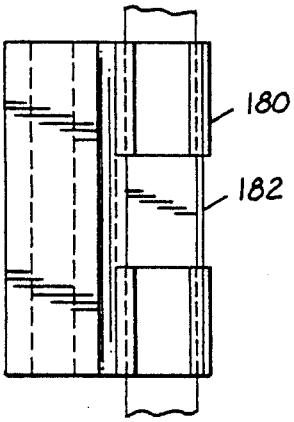

FIG. 43 is a top view showing drawer guides 180 received upon the guides 182. It is to be understood that guide 180 has two spaced portions which are received upon guides 182, thus allowing guide plates 106 to move smoothly along guide elements 182.

Figure 44:
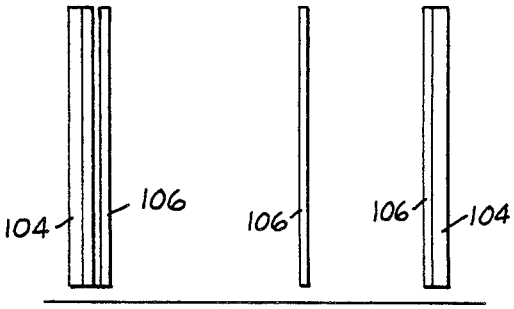
FIGS. 42–44 show details of the means for moving the seat bedpan unit between fourth and fifth positions.

FIG. 44 is a top view showing the arrangement of guides 104 receiving guide plates 106. There are three guide plates 106 with an intermediate one supporting the center of seat bedpan unit 52. There are three sets of guides 182 on center portion 38.

Figure 45:
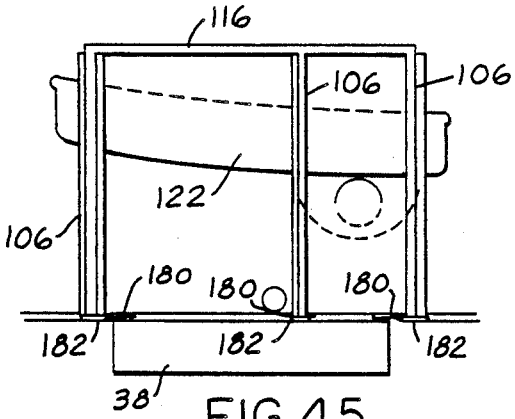
FIG. 45 illustrates details of the seat bedpan unit.

FIG. 45 is a cross-sectional view showing guides plates 106, and three drawer guides 180 and 182 which guide it for sliding movement relative to rotating bar 76 and unto bed center portion 38. Toilet bowl 122 is shown at a vertically upper portion.

Seat bedpan unit 52 has a member similar to guides 180 at the end which initially contacts center portion 38 of hospital bed 22. As seat bed pan unit 52 begins to slide along center portion 38, these guide members contact guides 182 in center portion 38 to guide seat bedpan unit 52. By the time seat bedpan unit reaches its fifth position, the guides on seat bedpan unit 52 have moved beyond the guides 182 on center portion 38. At this point, guides 180 on guide plates 106 are received upon guides 182 thus guiding seat bedpan unit 52 upon center portion 38. The seat bedpan unit can thus pivot upwardly to its sixth position while still being firmly guided upon center portion 38.

Figure 46:
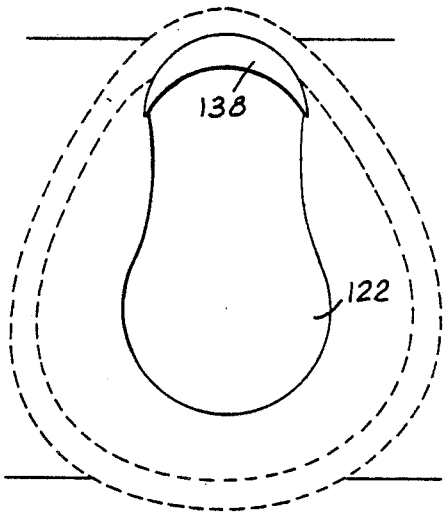
FIG. 46 is a top view of the seat bedpan unit.

FIG. 46 is a top view of toilet bowl 122 with forward cup 134 for patient alignment.

Figure 47:
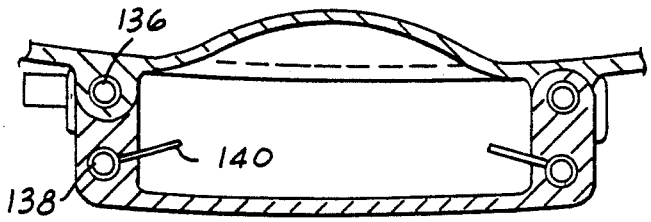
FIGS. 47–50 are cross-sectional views showing details of the seat bedpan unit.

FIG. 47 is a cross sectional view through toilet bowl 122. Tubing 136 supplies water for flushing. Also, tubing 138 supplies water to a bidet to wash a patient through nozzles 140, which are shown schematically. Preferably, four nozzles 140 are utilized to provide sufficient cleaning.

Figure 48:
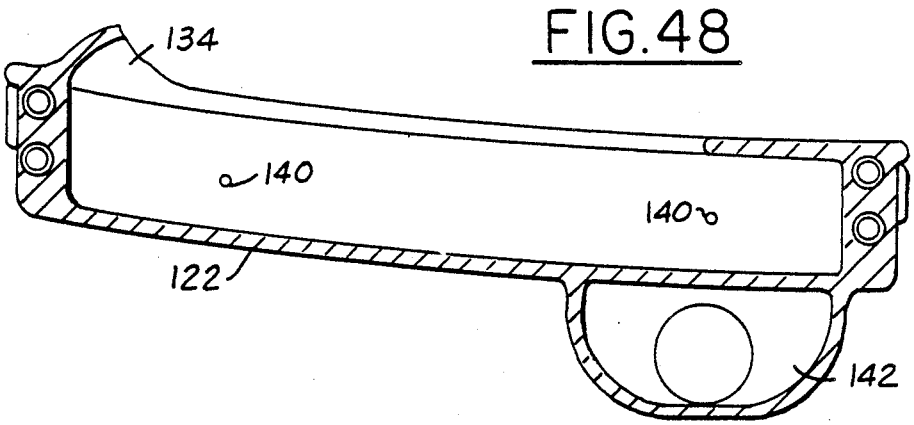

FIG. 48 is a cross sectional view through toilet bowl 122 along an axis perpendicular to the cross section illustrated in Figure 47. An outlet 142 is connected to line 114. Also, two nozzles 140 are illustrated.

Figure 49:
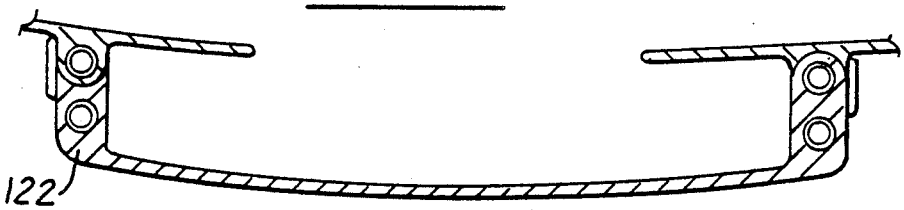
Figure 50:
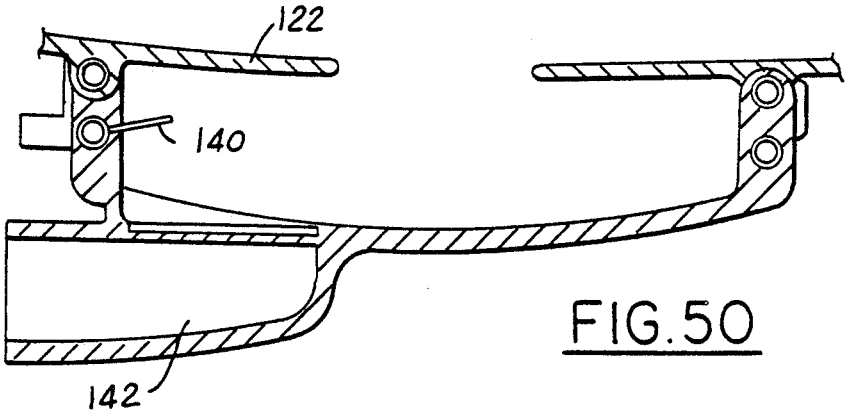

FIGS. 49 and 50 are cross-sectional views similar to Figure 48, but at different positions along toilet bowl 122. FIG. 49 is at the widest portion of toilet bowl 122 while FIG. 50 is near a rear portion of toilet bowl 122 and shows outlet 142 which leads to macerator pump 112 and then to a waste reservoir within outer cabinet 22.

Figure 51:
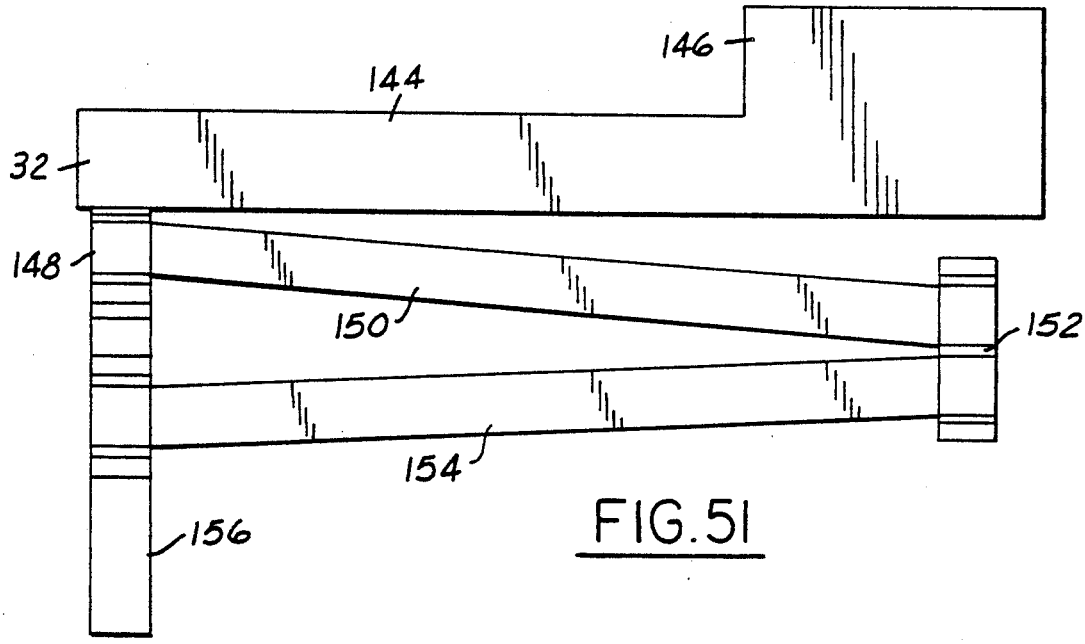
FIG. 51 shows the movement of a control tray.

Control tray 32 is shown in detail in FIG. 51 and includes a lower portion 144 and an upper portion 146. Control tray 32 is pivotally mounted at pivot 148 to a first bar 150. First bar 150 is pivotally connected at pivot point 152 to a second bar 154 which is pivotally connected at 156 to outer cabinet 25. A combination of pivot points 148, 152 and 156 allow control tray 32 to be normally stored over outer cabinet 25 but also to be movable outwardly over hospital bed 22.

Figure 52:
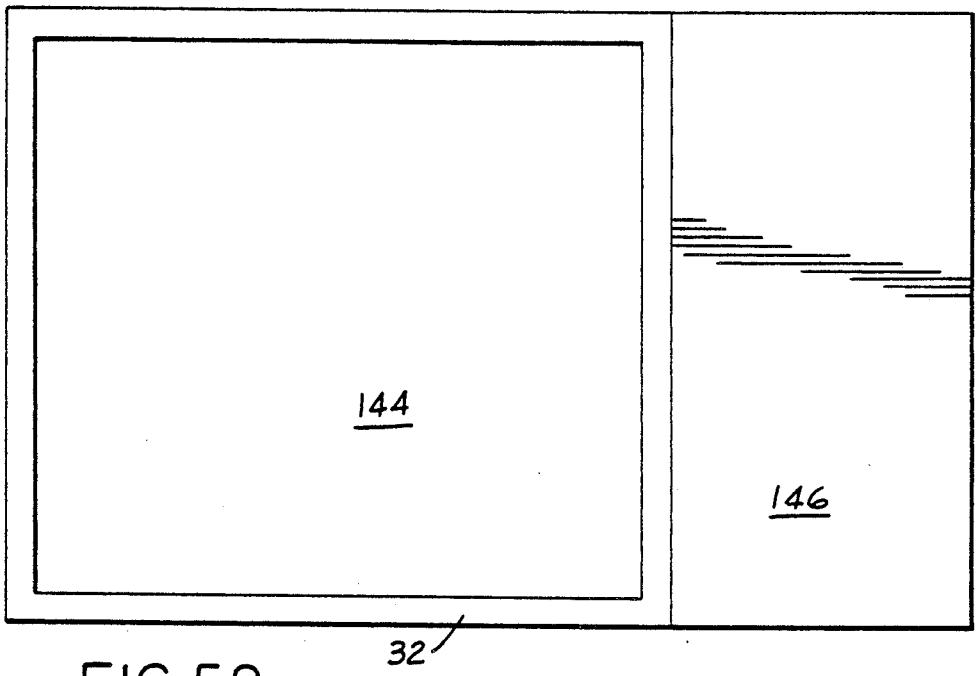
FIG. 52 illustrates a top view of the control tray.

FIG. 52 is a top view of control tray 32 showing lower portion 144 and upper portion 146.

Figure 53:
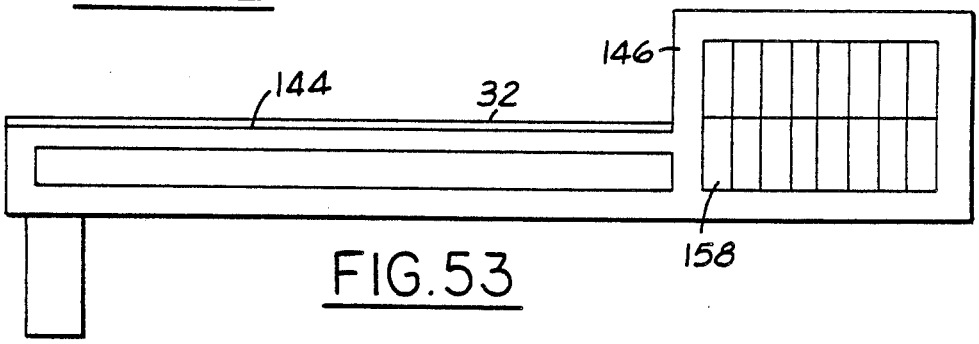
FIG. 53 is a side view of the control tray.

FIG. 53 is a side view of control tray 32 showing lower portion 144 and upper portion 146. Upper portion 146 is illustrated having a plurality of control buttons 158 for actuation of invalid toilet 20 by a patient.

Figure 54:
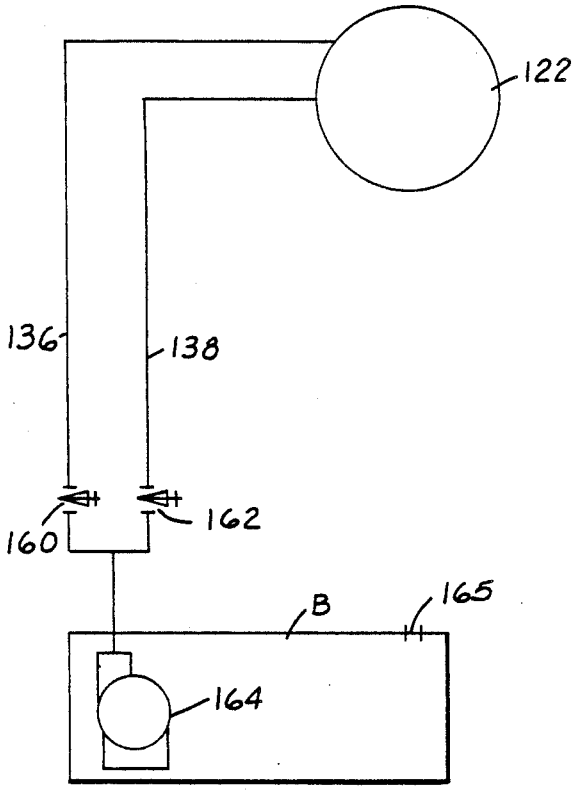
FIG. 54 is a schematic diagram showing the water system for the seat bedpan assembly.

FIG. 54 is schematic showing the water system for flushing toilet bowl 122. Supply lines 136 and 138 are controlled by magnetic solenoid valves 160 and 162. Water pump 164 is mounted in water holding tank B. Line 166 extends into tank B. The clean water is preferably heated to approximately body temperature before being used by the patient, particularly the water for the bidet. A vent 165 vents the water storage container to atmosphere allowing the water to be easily driven into the system. During use lubricating water may be supplied to toilet bowl 122.

Figure 55:
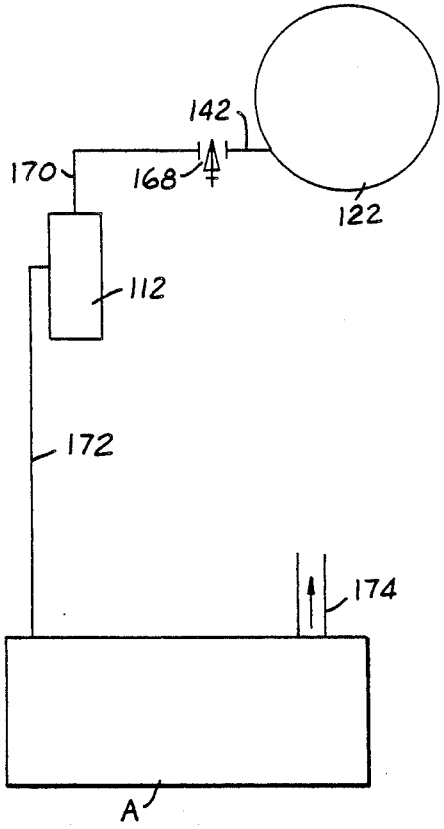
FIG. 55 is a schematic diagram showing the waste handling system.

FIG. 55 shows a schematic of the waste handling system for toilet bowl 122. Outlet 142 leads through magnetic solenoid valve 168 to line 170, into macerator pump 112, and then through line 172 to waste holding tank A. A vent line 174 leads through a charcoal filter to atmosphere.

When a patient has completed the use of the system a "completed use" switch is actuated. The water pump is started and flushing valve 160 is opened. Valve 168 is opened and macerator pump 112 is started. Once toilet bowl 122 has been sufficiently cleaned, valve 168 is closed and the bidet nozzles 140 are actuated. Water pump 164 supplies water through valve 162 to bidet nozzles 140 for cleansing of the patient. Once the patient has been cleansed, macerator pump 112 is again actuated and magnetic valve 168 is again opened. This completes the use of the toilet bowl 122 and thereafter the seat bedpan unit 52 is returned from its sixth position back to the first unactuated position.

Although invalid toilet 20 has been disclosed in combination with a particular type of hospital bed 22, it should be understood that the teachings of this invention can be applied to an invalid toilet utilized in combination with any type of hospital bed. The invalid toilets utilized with distinct types of hospitals bed would have their controls modified such that they would interface with the hospital bed in moving it to a position where seat bedpan unit 52 can be moved to a proper position for use.

A preferred embodiment of the present invention have been disclosed, however, a worker of ordinary skill in the art would realize that certain modifications would be within the scope of this disclosure. For this reason, the following claims should be studied in order to determine the true scope of an content of the present invention.

I claim:

1. A combination comprising:

an air inflatable hospital bed having a plurality of air inflatable sacks at the head, foot and center of the bed;

a toilet unit comprising an outer cabinet placed alongside said hospital bed near said center, said toilet unit including said outer an outer cabinet receiving a seat bedpan assembly in an unactuated first position; and means for moving said seat bedpan assembly to a position overlying said center of said hospital bed.

2. A combination as recited in claim 1, wherein said seat bedpan assembly is rectangular and has a longer dimension and a shorter dimension, said longer dimension extending vertically when said seat bedpan assembly is in said unactuated first position.

3. A combination as recited in claim 2, wherein said means for moving said seat bedpan assembly outside of said outer cabinet in a direction away from said hospital bed, rotates said seat bedpan assembly such that said longer dimension extends horizontally, and then moves said seat bedpan assembly back into and through said outer cabinet in a direction towards said hospital bed, such that it overlies said center of said hospital bed.

4. A combination as recited in claim 3, wherein said outer cabinet has normally closed openings in both the side facing said hospital bed and the side away from said hospital bed to allow the claimed movement of said seat bedpan assembly.

5. A combination as recited in claim 4, wherein a first motor drives an inner cabinet which carries said seat bedpan assembly outwardly of said outer cabinet in a direction away from said hospital bed and at least partially moves said seat bedpan assembly back into and through said outer cabinet in a direction towards said hospital bed, a second motor rotating said seat bedpan assembly.

6. A combination as recited in claim 5, wherein said first motor moves said inner cabinet between an extended position and a retracted position and a third motor movable with said inner cabinet moves said seat bedpan assembly through a final movement over said center of said hospital bed.

7. A combination as recited in claim 6, wherein said seat bedpan assembly is driven to rotate relative to said inner cabinet by a rotating bar.

8. A combination as recited in claim 7, wherein said third motor rotates with said rotating bar.

9. A combination as recited in claim 8, wherein said seat bedpan assembly may pivot with respect to said rotating bar.

10. A combination as recited in claim 9, wherein said air sacks at said center of said hospital bed are deflated when said seat bedpan assembly is moved over said center section.

11. A combination as recited in claim 10, wherein said air sacks are reinflated once said seat bedpan assembly overlies said center section, the reinflation causing said seat bedpan assembly to pivot upwardly relative to said rotating bar.

12. A combination as recited in claim 11, wherein control means are accessible to a patient in said hospital bed, said control means allowing actuation of said toilet unit.

13. A combination as recited in claim. 12, wherein said control means cause said head and foot of said hospital bed to be moved to an actuated position and provides a signal to a remote nurse station.

14. A combination as recited in claim 13, wherein said control means actuates said first, second and third motors.

15. A combination as recited in claim 12, wherein said control means deflate said air sacks at said center of said hospital bed.

16. A combination as recited in claim 1, wherein control means are accessible to a patient in said hospital bed, said control means allowing actuation of said toilet unit.

17. A combination as recited in claim 16, wherein said control means cause said head and foot of said hospital bed to be moved to an actuated position and provide a signal to a remote nurse station.

18. A combination as recited in claim 17, wherein said control means actuates said first, second and third motors.

19. A toilet unit comprising:

an outer cabinet to be placed alongside a hospital bed said outer cabinet receiving a seat bedpan assembly in an unactuated first position;

means for moving said seat bedpan assembly to a position overlying the hospital bed;

said seat bedpan assembly being rectangular and having a longer dimension and a shorter dimension, said longer dimension extending vertically when said seat bedpan assembly is in said unactuated first position;

said means for moving has a first motor which moves said seat bedpan assembly outside of said outer cabinet in one direction, a second motor which rotates said seat bedpan assembly such that said longer dimension extends horizontally, and said first motor then moves said seat bedpan assembly back into and through said outer cabinet in a second direction, away from said first direction, such that it at least partially overlies the hospital bed;

said outer cabinet has normally closed openings in the sides facing both said first and second directions to allow the movement of said seat bedpan assembly;

an inner cabinet carrying said seat bedpan assembly outwardly of said outer cabinet in said first direction and at least partially moves said seat bedpan assembly back into said second direction through said outer cabinet, said inner cabinet being driven by said first motor between an extended position and a retracted position and a third motor movable with said inner cabinet moves said seat bedpan assembly through a final movement over the hospital bed; and said seat bedpan assembly is driven to rotate relative to said inner cabinet by said second motor driving a rotating bar, said third motor rotating with said rotating bar, said seat bedpan assembly being pivotable with respect to said rotating bar.

20. A combination comprising:

an air inflatable hospital bed having a plural inflatable sacks at the head, foot and center of the bed;

a toilet unit receiving a seat bedpan assembly in an unactuated first position;

means for moving said seat bedpan assembly to a position overlying said center of said hospital bed; and control means accessible to a patient in said hospital bed and actuating said means for moving, said control means causing said head and foot of said bed to move to an actuated position and deflating said air sacks at said center, said control means providing a signal to a remote nurse station and actuating said means for moving.

21. A combination as recited in claim 20, wherein a control tray is selectively moved over the hospital bed, said control tray contains said control means, and movement of said control tray over said hospital bed making said control means accessible to a patient.

22. A combination as recited in claim 20, wherein said control means further actuated video equipment to provide a video signal from said hospital bed to the remote nurse station.

23. A combination as recited in claim 20, wherein said control means further record the time of actuation.

24. A combination comprising:

a hospital bed having a plurality of inflatable sacks at the head, foot, and center of the bed;

an invalid toilet comprising an outer cabinet placed alongside said hospital bed near said center, said invalid toilet having an outer cabinet receiving a seat toilet bedpan assembly in an unactuated first position; and control means for actuating both said hospital bed and said invalid toilet to positions for use of said invalid toilet by a patient in said hospital bed, the movement of said invalid toilet including moving said seat bedpan assembly to a position overlying said center of said hospital bed.

25. A combination as said in claim 24, wherein said inflatable sacks ion said hospital bed are inflatable by air.

26. A hospital bed "comprising a plurality of air inflatable sacks";

a toilet unit comprising an outer cabinet placed alongside said hospital bed near a center thereof, said toilet unit having said outer cabinet receiving a seat bedpan assembly in an unactuated first position; and means for moving said seat bedpan assembly outwardly of said outer cabinet to a position overlying said center of said hospital bed.

* * * * *